US007090620B1

(12) United States Patent
Barlow

(10) Patent No.: US 7,090,620 B1
(45) Date of Patent: Aug. 15, 2006

(54) BATTERY CHARGING ASSEMBLY

(76) Inventor: Michael J. Barlow, 931 Mount Pleasant Rd., Bryn Mawr, PA (US) 19010

( * ) Notice: Subject to any disclaimer, the term of this patent is extended or adjusted under 35 U.S.C. 154(b) by 0 days.

(21) Appl. No.: 11/129,715

(22) Filed: May 16, 2005

(51) Int. Cl.
*A63B 22/06* (2006.01)

(52) U.S. Cl. ..... 482/63; 482/2

(58) Field of Classification Search ..... 482/1, 482/2, 51, 54, 57; 290/1 R
See application file for complete search history.

(56) References Cited

U.S. PATENT DOCUMENTS

| | | | | |
|---|---|---|---|---|
| 3,904,920 | A | 9/1975 | Griffith | |
| 4,389,047 | A * | 6/1983 | Hall | 482/2 |
| 4,555,656 | A * | 11/1985 | Ryan | 322/1 |
| 5,050,865 | A | 9/1991 | Augspurger et al. | |
| 5,243,224 | A * | 9/1993 | Tagney, Jr. | 290/1 R |
| D377,672 | S | 1/1997 | Wanzer et al. | |
| 5,616,104 | A * | 4/1997 | Mulenburg et al. | 482/57 |
| 5,895,991 | A | 4/1999 | Butz | |
| 6,104,096 | A | 8/2000 | Hicks | |
| 6,124,699 | A * | 9/2000 | Suzuki et al. | 320/110 |
| 6,229,224 | B1 * | 5/2001 | Gagne | 290/1 R |
| 6,260,649 | B1 * | 7/2001 | Carney, Jr. | 180/220 |
| 6,641,952 | B1 * | 11/2003 | Maple | 429/157 |
| 6,717,280 | B1 * | 4/2004 | Bienville | 290/1 R |

* cited by examiner

*Primary Examiner*—Jerome Donnelly
*Assistant Examiner*—Tam Nguyen

(57) ABSTRACT

A battery charging assembly includes a stationary bike apparatus that includes a frame, a seat attached to the frame and an axle rotatably coupled to the frame. Each of a pair of pedals is coupled to the axle. An electrical generator is mounted on the frame and is mechanically coupled to the axle such that the generator generates electricity when the axle is rotated. A housing has a bottom wall and a perimeter wall that is attached to and extends upwardly from the bottom wall. A plurality of battery cradles is mounted in the housing. Each of the battery cradles has a size and shape for receiving and being electrically couplable to a rechargeable battery. Each of the battery cradles is electrically coupled to the generator so that rechargeable batteries mounted in the battery cradles are recharged when the axle is rotated.

6 Claims, 5 Drawing Sheets

BATTERY CHARGING ASSEMBLY

BACKGROUND OF THE INVENTION

1. Field of the Invention

The present invention relates to battery charging devices and more particularly pertains to a new battery charging device for recharging rechargeable batteries using electricity produced from a stationary bike assembly.

2. Description of the Prior Art

The use of battery charging devices is known in the prior art. U.S. Pat. No. 5,243,224 describes a wheel in which a person may run and which is coupled to a generator for generating electric current when the wheel is rotated. Another type of battery charging device is U.S. Pat. No. 4,555,656 which includes a generator and rechargeable battery assembly for use with a stationary bike. The battery and generator power monitoring equipment and electronics positioned on the electric bike. A similar device is found in U.S. Pat. No. 6,104,096.

While these devices fulfill their respective, particular objectives and requirements, the need remains for a device which utilizes the electricity that may be generated while using a stationary bike for the purpose of recharging rechargeable batteries. The batteries may then be used for powering small electronics. The device may also be used for recharging cellular phones and the like.

SUMMARY OF THE INVENTION

The present invention meets the needs presented above by comprising a stationary bike apparatus that includes a frame, a seat attached to the frame and an axle rotatably coupled to the frame. Each of a pair of pedals is coupled to the axle. An electrical generator is mounted on the frame and is mechanically coupled to the axle such that the generator generates electricity when the axle is rotated. A housing has a bottom wall and a perimeter wall that is attached to and extends upwardly from the bottom wall. A plurality of battery cradles is mounted in the housing. Each of the battery cradles has a size and shape for receiving and being electrically couplable to a rechargeable battery. Each of the battery cradles is electrically coupled to the generator so that rechargeable batteries mounted in the battery cradles are recharged when the axle is rotated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
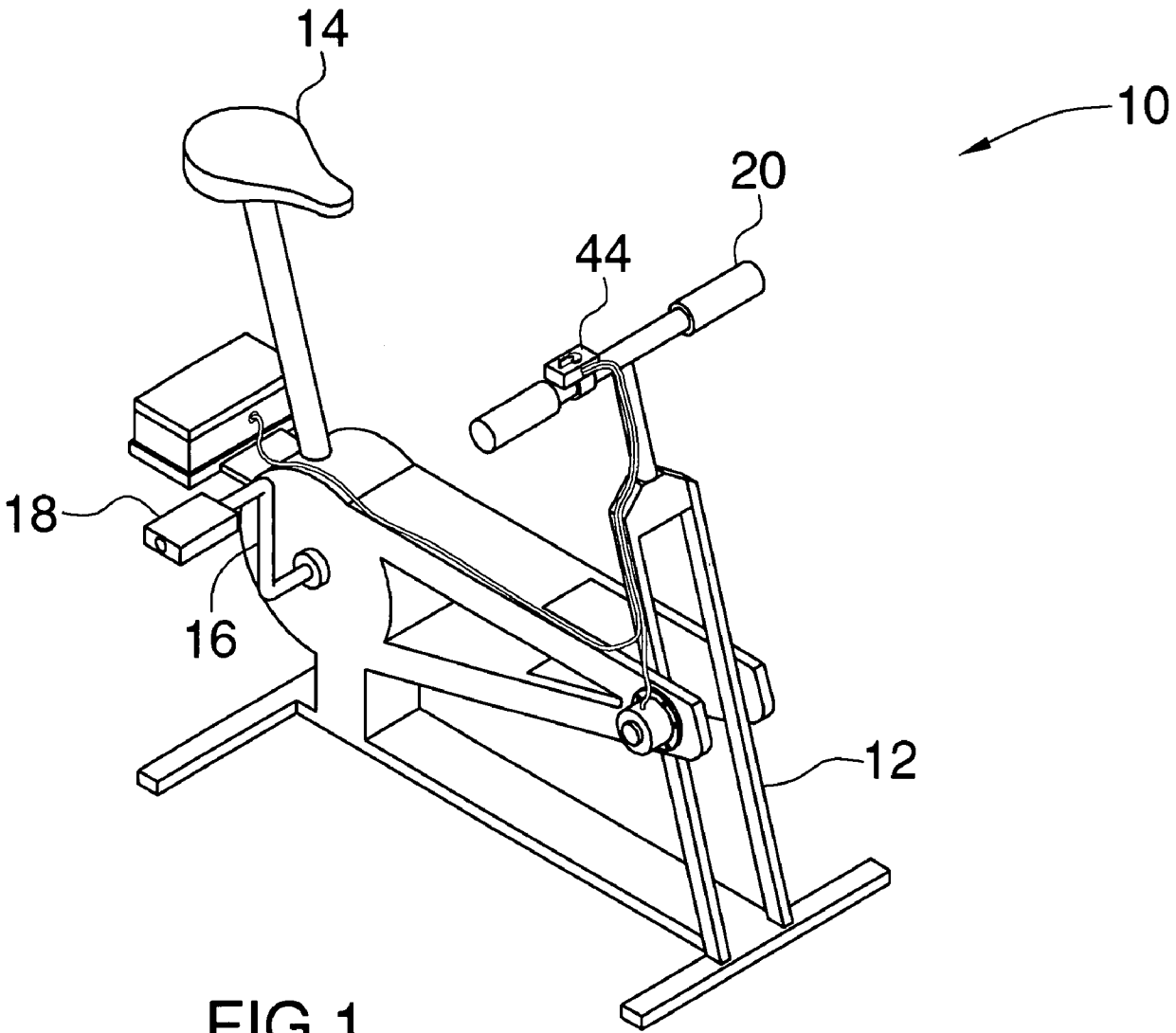
FIG. 1 is a perspective view of a battery charging assembly according to the present invention.
Figure 2:
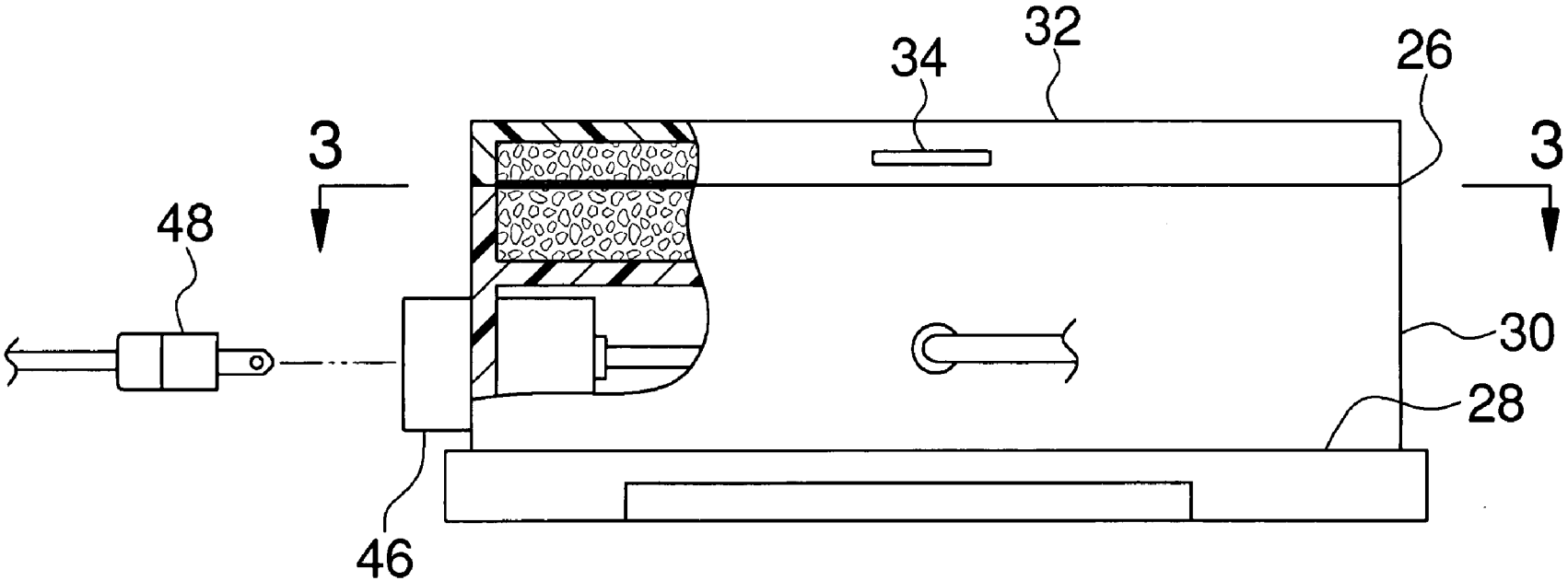
FIG. 2 is a front view of a housing of the present invention.
Figure 3:
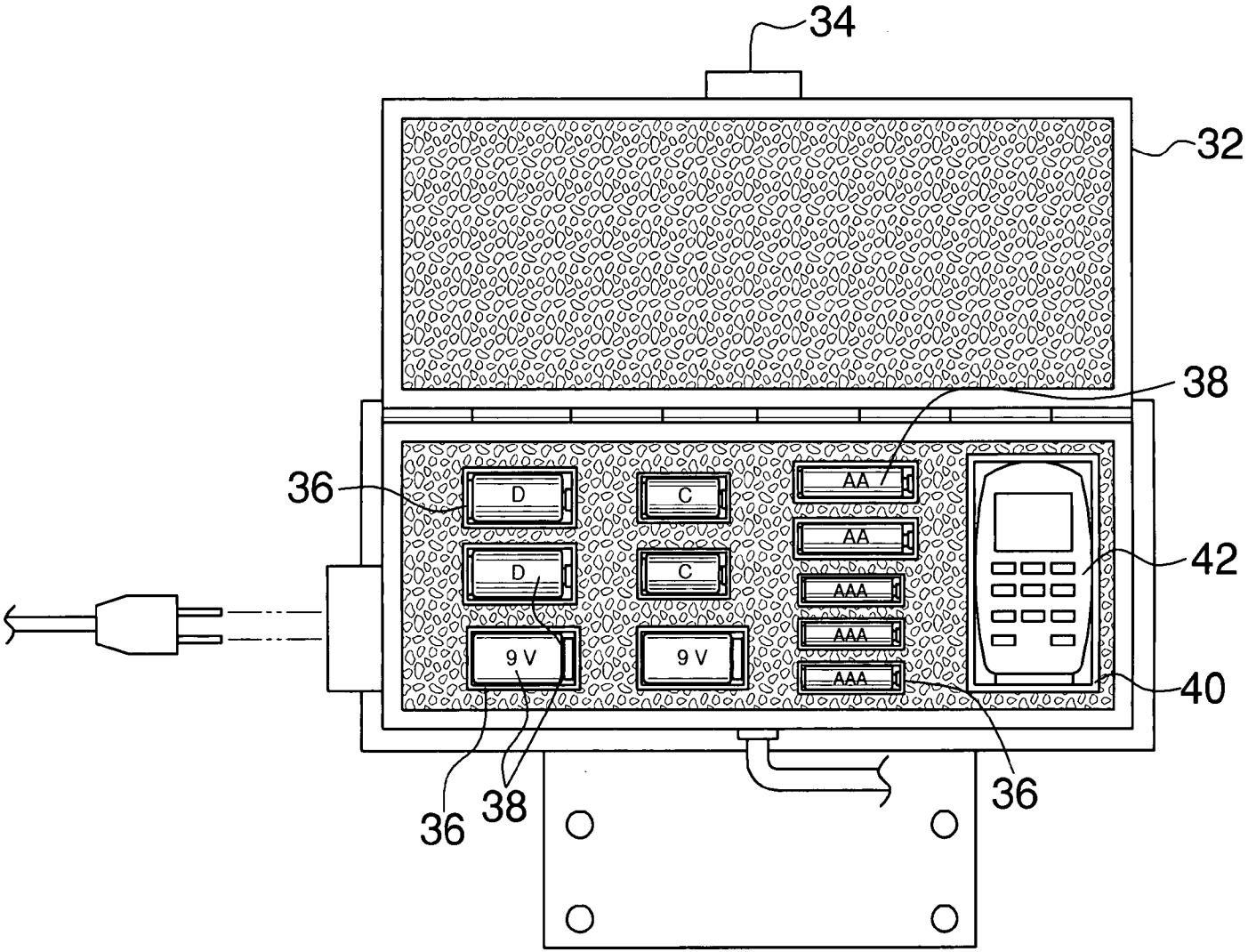
FIG. 3 is a top view of the housing the present invention.
Figure 5:
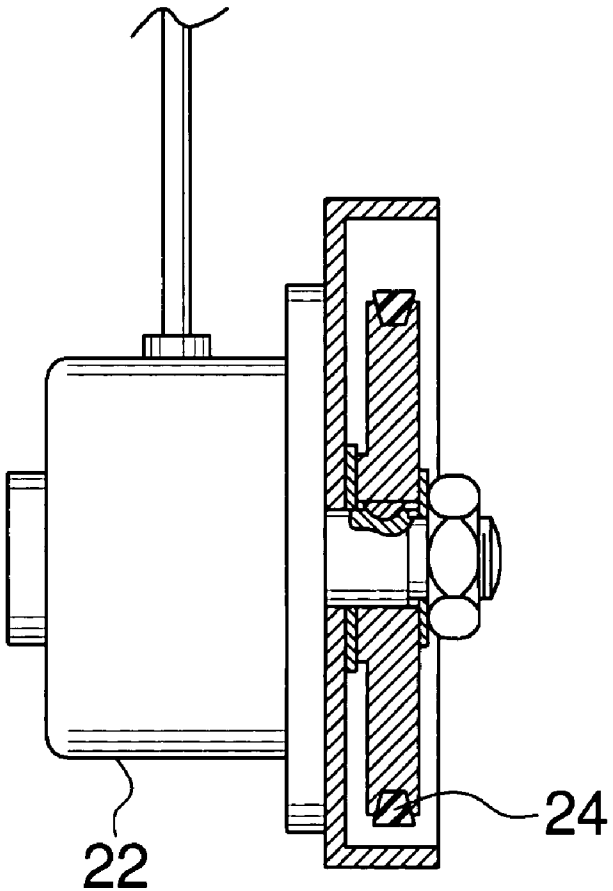
FIG. 5 is a cross-sectional view taken along line 5—5 of FIG. 4 of the present invention.
Figure 4:
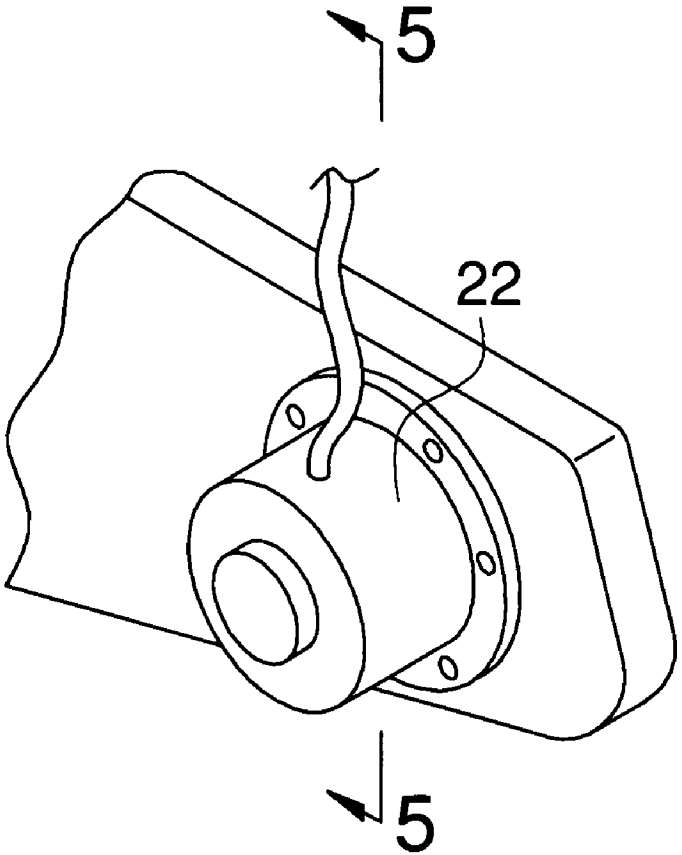
FIG. 4 is a perspective view of a generator of the present invention.
Figure 6:
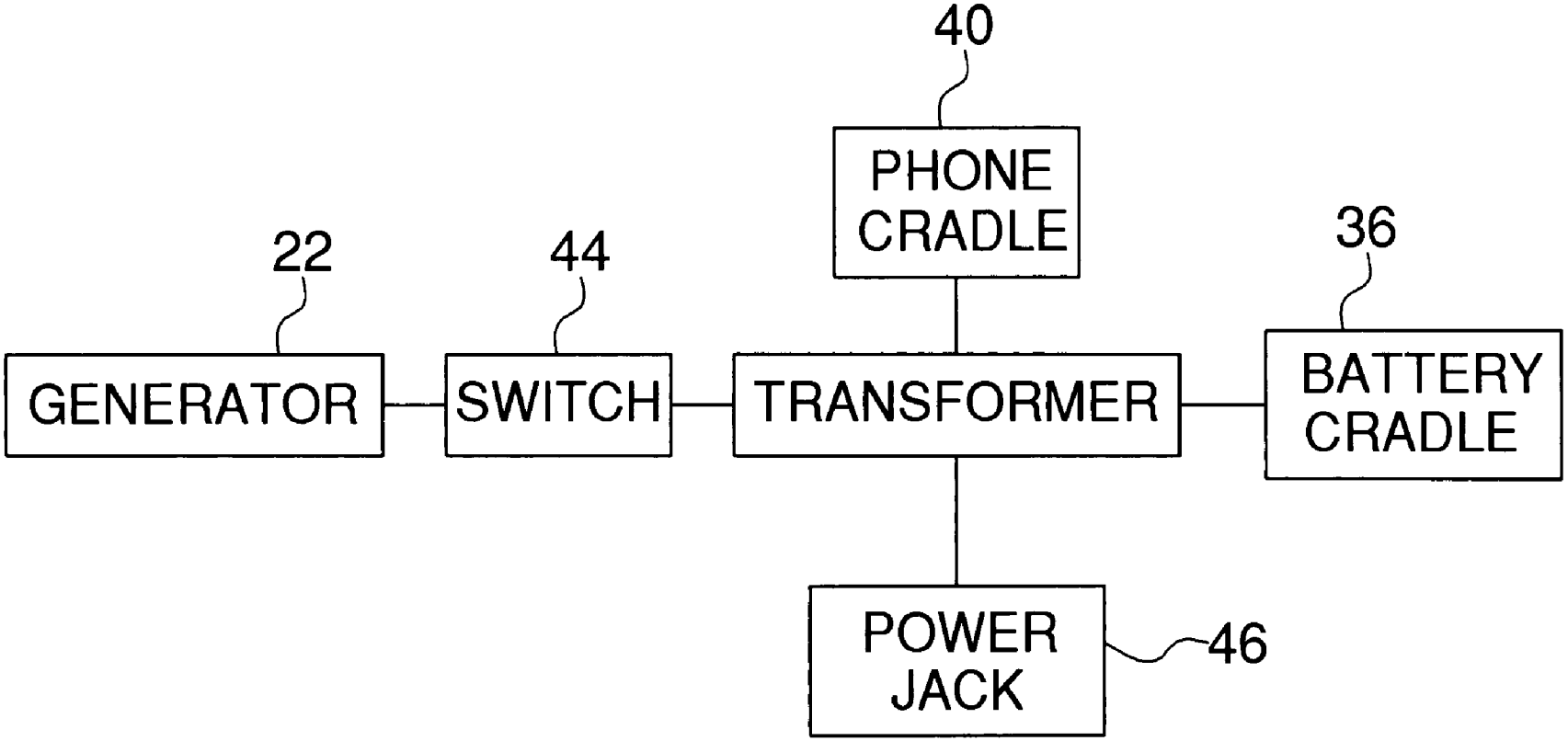
FIG. 6 is a schematic view of the present invention.

With reference now to the drawings, and in particular to FIGS. 1 through 6 thereof, a new battery charging device embodying the principles and concepts of the present invention and generally designated by the reference numeral 10 will be described.

As best illustrated in FIGS. 1 through 6, the battery charging assembly 10 generally comprises a stationary bike apparatus that includes a frame 12, a seat 14 attached to the frame 12 and an axle 16 rotatably coupled to the frame 12. Each of a pair of pedals 18 is coupled to the axle 16.

An electrical generator 22 is mounted on the frame 12 and is mechanically coupled to the axle 16 so that the generator 22 generates electricity when the axle 16 is rotated. The generator 22 may be any common generator such as is often used on stationary bikes for the purpose of powering monitoring equipment on the stationary bike. The generator 22 may be coupled to a belt 24 extending between the axle 16 and the generator 22.

A housing 26 has a bottom wall 28 and a perimeter wall 30 that is attached to and extends upwardly from the bottom wall 28. A covering 32 is hingedly coupled to an upper edge of the perimeter wall 30 for selectively opening or closing the housing 26. A handle 34 is attached to the covering 32. The housing 26 is positioned adjacent to the seat 14.

A plurality of battery cradles 36 is mounted in the housing 26. Each of the battery cradles 36 has a size and shape adapted for receiving and being electrically couplable to a rechargeable battery 38. The battery cradles 36 are each electrically coupled to the generator 22 so that rechargeable batteries 38 mounted in the battery cradles 36 are recharged when the axle 16 is rotated. The battery cradles 36 are generally conventional cradles used for recharging rechargeable batteries 38.

A phone cradle 40 is mounted in the housing 26 and is adapted for receiving and is electrically coupled to a cellular phone 42. The phone cradle 40 is electrically coupled to the generator 22 so that a cellular phone 42 mounted in the phone cradle 40 is recharged when the axle 16 is rotated. The phone cradle 40, like the battery cradles 36, can be any conventional design and structure adapted for receiving and charging a cellular phone battery.

A switch 44 is electrically coupled to the generator 22 for selectively turning off electrical current between the generator 22 and the battery 36 and phone 40 cradles. The switch 44 is preferably mounted on the frame 12 of the stationary bike on or adjacent to handles 20 attached to the frame 12.

A female plug 46 is electrically coupled to the phone 40 and battery 36 cradles for selectively receiving and electrically coupling a male power plug 48 to the battery 36 and phone 40 cradles. The female plug 46 allows a person to use a secondary source of electricity to recharge batteries 38 and a cell phone 42.

In use, phone 40 and battery 36 cradles are selectively filled with batteries 38 and/or a cellular phone 42 so that those devices may be recharged. The cradles 36, 40 preferably have a variety of sizes for fitting AAA batteries, AA batteries, C batteries, D batteries and 9-volt batteries. The user pedals the stationary bike so that the axle 16 rotates and causes the generator 22 to produce electricity. The electricity generated in this manner is used to recharge the batteries 38 and cellular phone 42. Once recharged, the batteries 38 and cellular phone 42 are removed from their respective cradles 36, 40 and used in a conventional manner.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A battery charging assembly comprising:

a stationary bike apparatus including a frame, a seat attached to said frame and an axle rotatably coupled to said frame, each of a pair of pedals being coupled to said axle;

an electrical generator being mounted on said frame and being mechanically coupled to said axle such that said generator generates electricity when said axle is rotated;

a housing having a bottom wall and a perimeter wall being attached to and extending upwardly from said bottom wall;

a plurality of battery cradles being mounted in said housing, each of said battery cradles having a size and shape for receiving and being electrically couplable to a rechargeable battery, each of said battery cradles being electrically coupled to said generator such that rechargeable batteries mounted in said battery cradles are recharged when said axle is rotated; and a phone cradle being mounted in said housing and being adapted for receiving and being electrically coupled to a cellular phone, said phone cradle being electrically coupled to said generator such that a cellular phone mounted in said phone cradle is recharged when said axle is rotated.

2. The battery charging assembly according to claim 1, further including a covering being hingedly coupled to an upper edge of said perimeter wall for selectively opening or closing said housing.

3. The battery charging assembly according to claim 1, further including a switch being electrically coupled to said generator for selectively turning off electrical current between said generator and said battery cradles.

4. The battery charging assembly according to claim 3, further including a female plug being electrically coupled to said phone and battery cradles for selectively receiving and electrically coupling a male power plug to said battery cradles, the male power plug providing electrical power to said battery cradles.

5. The battery charging assembly according to claim 1, further including a female plug being electrically coupled to said phone and battery cradles for selectively receiving and electrically coupling a male power plug to said battery cradles, the male power plug providing electrical power to said battery cradles.

6. A battery charging assembly comprising:

a stationary bike apparatus including a frame, a seat attached to said frame and an axle rotatably coupled to said frame, each of a pair of pedals being coupled to said axle;

an electrical generator being mounted on said frame and being mechanically coupled to said axle such that said generator generates electricity when said axle is rotated;

a housing having a bottom wall and a perimeter wall being attached to and extending upwardly from said bottom wall, a covering being hingedly coupled to an upper edge of said perimeter wall for selectively opening or closing said housing;

a plurality of battery cradles being mounted in said housing, each of said battery cradles having a size and shape for receiving and being electrically couplable to a rechargeable battery, each of said battery cradles being electrically coupled to said generator such that rechargeable batteries mounted in said battery cradles are recharged when said axle is rotated;

a phone cradle being mounted in said housing and being adapted for receiving and being electrically coupled to a cellular phone, said phone cradle being electrically coupled to said generator such that a cellular phone mounted in said phone cradle is recharged when said axle is rotated;

a switch being electrically coupled to said generator for selectively turning off electrical current between said generator and said battery and phone cradles; and a female plug being electrically coupled to said phone and battery cradles for selectively receiving and electrically coupling a male power plug to said battery and phone cradles.

* * * * *